United States Patent [19]

Atkinson

[11] 4,286,720

[45] Sep. 1, 1981

[54] COUNTERWEIGHT REMOVAL SYSTEM AND METHOD

[75] Inventor: John Atkinson, Bishop Auckland, England

[73] Assignee: Coles Cranes Limited, Sunderland, England

[21] Appl. No.: 70,956

[22] Filed: Aug. 30, 1979

[30] Foreign Application Priority Data

Sep. 5, 1978 [GB] United Kingdom ..... 35701/78

[51] Int. Cl.[3] ..... B66C 23/74

[52] U.S. Cl. ..... 212/178; 212/195

[58] Field of Search ..... 212/156, 178, 191, 195, 212/197, 198, 270; 414/673, 719, 337, 338, 389; 254/5 R, 5 B, 5 C

[56] References Cited

U.S. PATENT DOCUMENTS 1,499,971 7/1924 Callison ..... 414/337

FOREIGN PATENT DOCUMENTS 964154 7/1964 United Kingdom ..... 212/178

1291541 4/1972 United Kingdom ..... 212/178

*Primary Examiner*—Robert G. Sheridan

*Attorney, Agent, or Firm*—Townsend and Townsend

[57] ABSTRACT

Mobile cranes have a jib mounted on a platform or deck of a road vehicle so that the crane can be transported from one working site to another. Such a crane may have a counterweight on the rear of the crane jib superstructure and mounted so that it can be moved inwardly and outwardly relative the superstructure to balance the load on the jib. When the crane is to be driven along the rod, however, the jib is folded over the platform of the vehicle and in addition the counterweight is desirably removed from the jib superstructure and carried in a position on the vehicle platform where its weight best suits the vehicle suspension. In order to remove the counterweight, the superstructure is slewed to bring the counterweight to a position adjacent an upwardly inclined surface carried by the platform of the vehicle, the bottom surface of the counterweight being inclined at a corresponding angle to the horizontal equal to that of the inclined surface. The counterweight is then moved to engage the underside of the counterweight with the inclined surface on the platform and cause the counterweight to "ride up" the inclined surface of the block. In this position, the load on the beams carrying the counterweight is removed so that the counterweight can be removed and tied to the vehicle platform for travel. In this way, the hydraulic rams or the like which control the balancing movements of the counterweight can be used in the disengagement and re-engagement of the counterweight and no extra hydraulic rams are needed.

10 Claims, 6 Drawing Figures

COUNTERWEIGHT REMOVAL SYSTEM AND METHOD

This invention relates to cranes and in particular to mobile cranes, i.e. cranes in which the crane jib is mounted on a platform or deck of a road vehicle to enable the crane to be transported from one working site to another.

BACKGROUND TO THE INVENTION

One type of such crane has a counterweight which is mounted on a beam assembly at the rear end of the crane jib superstructure. The beam assembly and counterweight is movable out from or towards the superstructure by the use of hydraulic rams or the like to balance the jib under varying loads.

When such a crane is to be driven along a road, the jib is folded down over the deck or platform of the vehicle and secured thereto and it is desirable for the counterweight to be removed from the superstructure and secured to the vehicle, not at one end, but rather in a position where its weight can better be carried by the vehicle suspension. Hitherto, in order to remove the counterweight from the beam, it has been necessary first to contract the beam towards the crane superstructure. Then, by using a vertically acting hydraulic ram to support the counterweight whilst it is unbolted from the beam and finally using the "vertical" hydraulic ram, to lower the counterweight to the deck of the vehicle where it is secured for travel.

This previously proposed system requires two degrees of movement and hence two rams or sets of rams, namely an "in" movement of the beam and a "down" movement of the counterweight. Similarly for reattachment, the counterweight has had to be lifted up and secured to the beam and the beam then moved in towards the jib superstructure.

It is therefore an object of the invention to simplify the removal and reattachment of the counterweight whilst still allowing the counterweight to be fixed to a desired position on the vehicle.

BRIEF SUMMARY OF THE INVENTION

According to the invention there is provided a method of preparing a mobile crane for travelling from one working site to another in which the jib superstructure is slewed to position a counterweight attached to the superstructure by an extensible beam assembly adjacent an upwardly inclined surface formed on or carried by the platform or deck of the vehicle, the undersurface of the counterweight being inclined at a substantially equal angle to the horizontal to that of the upwardly inclined surface, and the counterweight is then moved by the beam assembly so that the upwardly inclined surface on the platform or deck and the undersurface of the counterweight engage and the counterweight is caused to ride up the upwardly inclined surface and be supported thereon, whereupon the counterweight can be detached from the beam assembly and tied down for travelling.

Once the counterweight has been detached in this way, the superstructure and jib are, if necessary, slewed to a position for travelling and the jib is then folded down to its travelling position and secured to the deck or platform of the vehicle.

To reattach the counterweight, the beam assembly when the crane reaches the new site, the procedure is reversed. Thus, the end of the beam assembly is positioned over the counterweight and resecured thereto. Then the beam and/or superstructure is operated to slide the counterweight down from the inclined surface.

It will be appreciated that only the hydraulic rams needed to operate the jib are required and that no ram to lift the counterweight "up and down" is needed.

If, as is desirable, the counterweight is bolted to the end of the beam, then the movement of the counterweight up the inclined surface relieves the bolts from load enabling them readily to be removed and later reinserted in their connecting position.

Also according to the invention, there is provided a mobile crane which has a counterweight which is carried by a beam assembly and which is movable inwardly and outwardly relative the jib superstructure to assist in balancing the load on the jib, a surface inclined to the horizontal on or carried by the deck or platform of the vehicle for supporting the counterweight during travelling, the counterweight having an undersurface which is inclined to the horizontal at substantially the same angle as the inclined surface on the deck or platform, the end surface on or carried by the deck or platform being positioned and arranged so as to be able to engage the underside of the counterweight upon movement of the beam assembly after the superstructure has been slewed to an appropriate position, continued movement of the beam assembly causing the counterweight to ride up the said surface.

Preferably, the inclined surface of the vehicle is provided on a reaction block, removably mounted on a seat on the deck or platform of the vehicle.

In one preferred embodiment of the invention, the beam assembly is movable to move the counterweight along a path which is inclined to the horizontal at an angle substantially equal but in the opposite sense to the upwardly inclined surface. This has the advantage that the angle of the underside of the counterweight to the horizontal can be kept reasonably small so that during travel from one site to another there is not too much tendency from the counterweight to slip yet at the same time there is relatively quick clearance of the counterweight from the inclined surface during reattachment of the counterweight to the beam assembly.

The angle of the inclined surface to the horizontal may conveniently be about 3°.

DESCRIPTION OF THE DRAWINGS

The invention will now be described, by way of example, with reference to the accompanying drawings, in which.

DESCRIPTION OF THE PREFERRED EMBODIMENT

Figure 1:
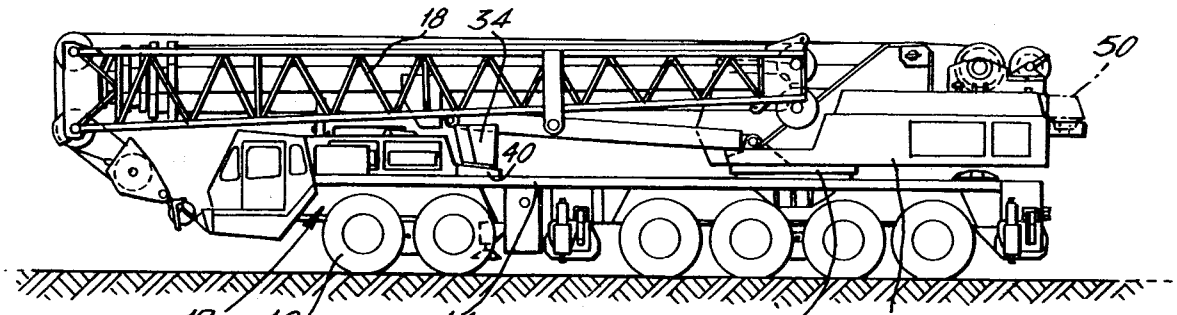
FIG. 1 is a side elevation of one embodiment of mobile crane in accordance with this invention showing its jib folded down for travel.

The mobile crane shown in FIG. 1 comprises a vehicle 12 provided with a deck or platform 14 mounted on wheels 16 to enable the vehicle to be driven along a road or the like. The platform 14 carries a conventional crane jib 18 which is shown in FIG. 1 in its folded-down position ready for travel.

The jib is mounted on a turntable 20 together with superstructure 22 extending horizontally out from the turntable as can be seen in FIG. 1.

Figure 2:
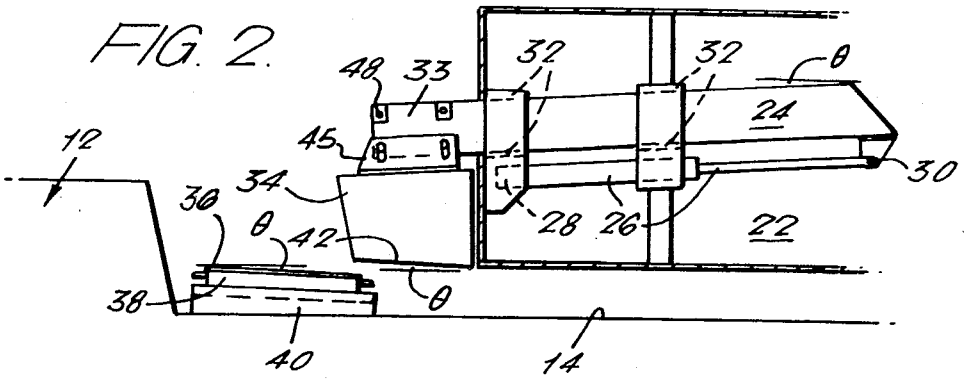
FIG. 2 is a diagram of part of the crane shown in FIG. 1 showing the extendable beam assembly and counterweight.
Figure 3:
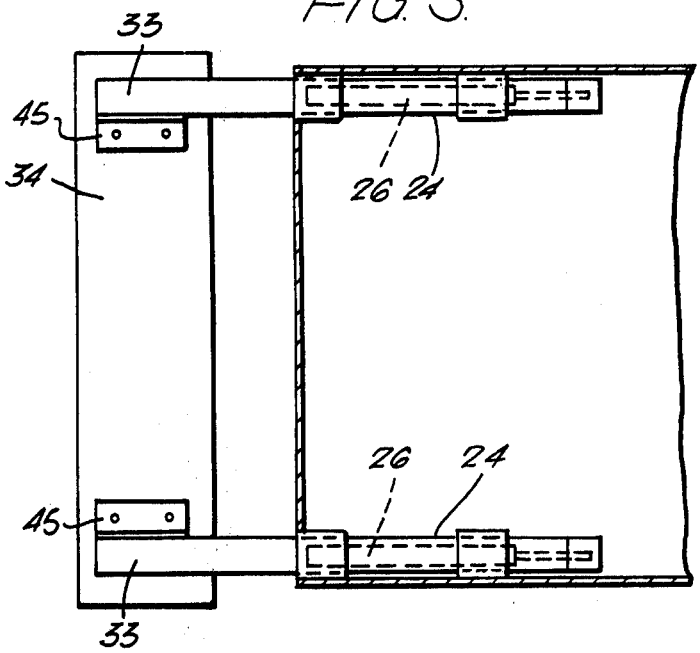
FIG. 3 is a plan diagram of the beam assembly and counterweight.
Figure 4:
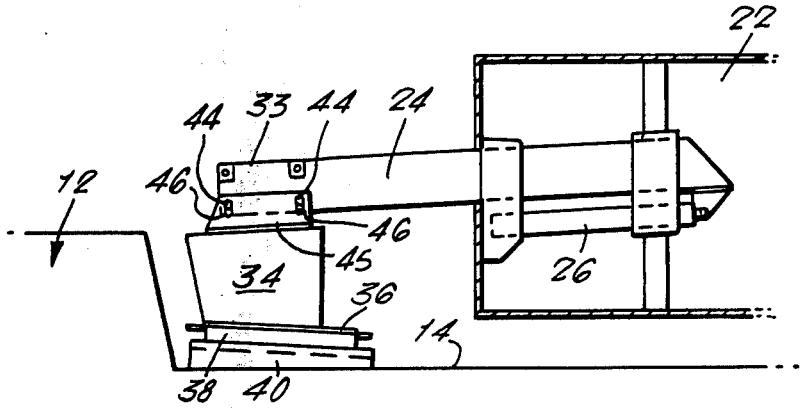
FIG. 4 is a view similar to FIG. 2 but showing the counterweight engaged with a block on the deck or platform of the vehicle.

The superstructure 22 carries a beam assembly, the beams 24 (see FIGS. 2 to 6) of which are movable from the position shown in FIGS. 1 and 2 in which they are substantially contracted within the superstructure 22 to an extended position shown in FIG. 4. The beams 24 are moved by a pair of hydraulic rams 26, one for each beam, positioned within the superstructure and connected between a block 28 of the superstructure and a lug 30 attached to the inner end of beam 24. The beams 16 slide in bearings 32 carried by the superstructure and similar bearings in the blocks 28.

As best shown in FIG. 3, there are a pair of beams 24, one extending out from each side of the superstructure 22 and connected to the outer ends 33 of these beams is a removable counterweight 34. In use, this counterweight can therefore be positioned outwardly from the superstructure 22 at varying distances by extension or contraction of the rams 26 to balance the jib under varying loads. The counterweight 34 has upwardly extending flanges 45 which are bolted to the ends 33 of the beams 24 by means of bolts 44 which pass through slots 46 in the flanges and holes 48 in the beams.

When it is desired to move the crane from one operating site to another, the beams 24 are contracted to the position shown in FIG. 2 by extension of the rams 26 and the jib and superstructure is then slewed to the position shown in FIG. 2. In this position, the counterweight 34 is located adjacent to and in line with an inclined surface 36 of a reaction block 38 which is removably mounted in a seat 40 secured to the deck or platform 14 of the crane vehicle. As will be seen, the angle $\theta$ by which the said surface 36 is inclined to the horizontal and which, may for example, be about 3° corresponds with the angle at which the bottom surface 42 of the counterweight also extends to the horizontal. This angle $\theta$ is also the angle at which the movable beams 24 extend to the horizontal but in a sense opposite to that at which the surfaces 36 and 42 are inclined.

Once in this position the rams 26 are contracted causing the beams 24 and hence the counterweight to move outwardly relatively to the superstructure 22. The surfaces 42 and 36 engage and then as shown in FIG. 4 the counterweight rides up over the block and so becomes supported thereby.

In this position, the bolts 44 which connect the counterweight to the ends of the beams 24 are relieved of their load and so they can readily be removed. The counterweight is then tied down or secured to the deck 14.

Figure 5:
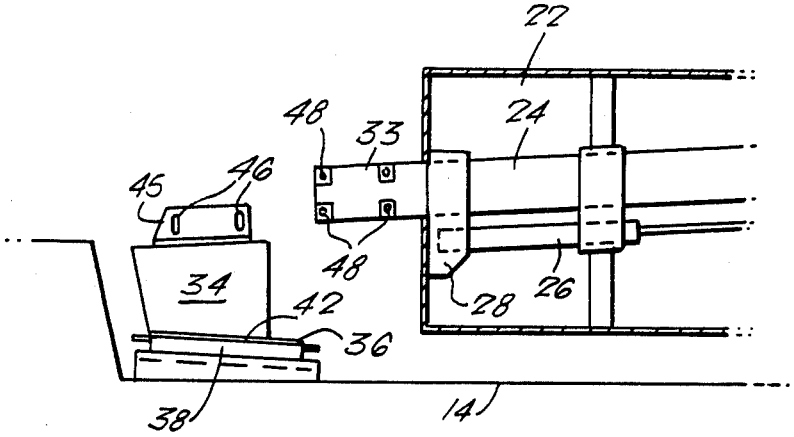
FIG. 5 is a view similar to FIG. 2 showing the counterweight secured for travel.

After removal of the counterweight, the beams 24 are contracted towards the superstructure 22 by extension of the rams 26 to the position shown in FIG. 5 so enabling the jib then to be slewed to the position shown in FIG. 1 at which it can be secured in a stable position for travel.

As can be seen in FIG. 1, the seat 40 for the counterweight, is secured to the deck or platform 14 of the crane vehicle at an appropriate desired position so that the counterweight can readily be supported during travel with a balanced axle loading.

When the crane reaches a new site and the jib is again erected, the jib will then be slewed through approximately 180° from the position shown in FIG. 1 to the position shown in FIG. 5 at which the ends of the beam are again positioned adjacent the counterweight. The beam assembly is then extended out from the superstructure 22 by operation of the rams 26 to a position similar to that shown in FIG. 4 and the bolts 44 are then secured through the slots 46 in the counterweight and corresponding holes 48 in the outer ends 33 of the beams.

The beams 24 are then again contracted into the superstructure by extension of the rams 26, causing the counterweight 34 to slide off from its block 38 ready for use.

Figure 6:
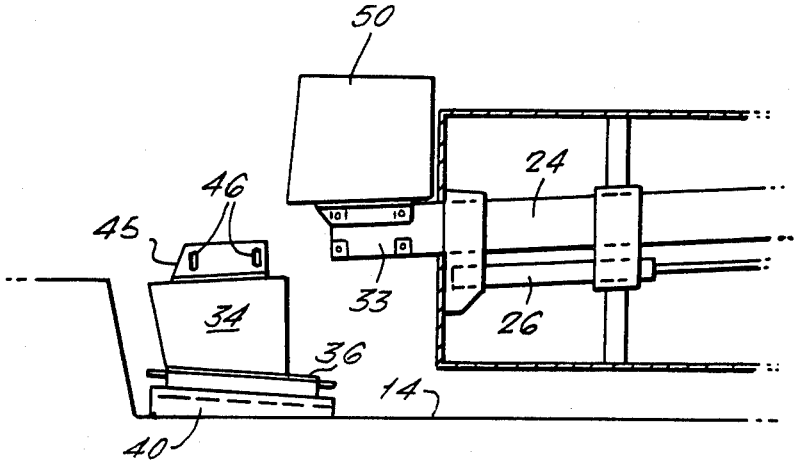
FIG. 6 is a view similar to FIG. 5 showing a modified embodiment in which an additional counterweight is provided.

In the modification shown in FIG. 6, the beams 14 carry an additional fixed counterweight 50 which extends across the rear ends 33 of the two beams 24 to provide additional balance weight. This additional counterweight 50 will not normally be removed during travel but will remain attached to the beams in the position indicated by the broken lines in FIG. 1.

Equally, a combined counterweight can be carried beneath the beams and removed therefrom by use of the invention.

The invention has the advantage, not only of avoiding the need for two sets of hydraulic rams, but also of enabling the counterweight to be detached from the beam and reattached when necessary in a fast and convenient manner.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

What we claim is:

1. A method of preparing a mobile crane for travelling from one working site to another, said mobile crane comprising a platform, an upwardly inclined surface on said platform, a jib and superstructure mounted for slewing on said platform, a jib pivoted to said superstructure, an extensible beam assembly carried by said superstructure and a counterweight attached to said beam assembly, said counterweight having an underside inclined at a substantially equal angle to the horizontal as said upwardly inclined surface, in which:

said jib structure is slewed to position said counterweight adjacent said upwardly inclined surface, said counterweight is moved by said beam assembly in a direction away from said superstructure to engage said underside of said counterweight and said upwardly inclined surface and cause said counterweight to ride up said upwardly inclined surface so that said counterweight is supported on said surface, and detaching said counterweight from said beam assembly and tieing it down onto said platform for travelling.

2. A method according to claim 1, further comprising slewing said superstructure and jib to a position for travelling after detachment of said counterweight, and folding said jib down and securing it to said platform of said vehicle.

3. A method according to claim 1, in which said counterweight is attached to said beam assembly by bolts.

4. A method according to claim 1, in which said beam assembly moves said counterweight along a path which is inclined to the horizontal at an angle substantially equal, but in the opposite sense, to said upwardly inclined surface.

5. A mobile crane comprising:

a platform, a jib superstructure mounted for slewing on said platform, an upwardly inclined surface on said platform wherein the elevation of said upwardly inclined surface above said platform increases as the distance from said superstructure increases, a jib pivoted to said superstructure, an extensible beam assembly carried by said superstructure, a counterweight attached to said beam assembly to assist in balancing a load on said jib, said counterweight having an underside inclined at a substantially equal angle to the horizontal as said upwardly inclined surface, said upwardly inclined surface being capable of supporting a counterweight during travelling, and said upwardly inclined surface being positioned and arranged so as to be able to engage said underside of said counterweight upon movement as said beam assembly after said superstructure has been slewed to an appropriate position, continued movement of said beam assembly causing said counterweight to ride up said inclined surface and be supported thereby.

6. A mobile crane according to claim 5 in which said beam assembly comprises a pair of beams, one on either side of said superstructure, and hydraulic rams for moving said beams in unison inwardly and outwardly relative said superstructure, said beams having outer ends to which said counterweight is attached.

7. A mobile crane according to claim 6, further comprising bolts for attaching said counterweight to said beams, one of said beams or counterweight having holes and the other having slots through which said bolts pass for attachment of said counterweight to said beams.

8. A mobile crane according to claim 6, in which said beams are carried by said superstructure so as to be movable along a path which is inclined to the horizontal at an angle substantially equal but in the opposite sense to said inclined surface.

9. A mobile crane according to claim 5, further comprising a block removably mounted on said platform on which said upwardly inclined surface is provided.

10. A mobile crane according to claim 5, in which said upwardly inclined surface is inclined at about 3° to the horizontal.

* * * * *